US006511091B1

(12) United States Patent
Su et al.

(10) Patent No.: US 6,511,091 B1
(45) Date of Patent: Jan. 28, 2003

(54) FIXING STRUCTURE FOR SKIS

(76) Inventors: Chorng-Chyi Su, P.O. Box 82-144, Taipei (TW); Yamamoto Tatekazu, P.O. Box 82-144, Taipei (TW)

( * ) Notice: Subject to any disclaimer, the term of this patent is extended or adjusted under 35 U.S.C. 154(b) by 0 days.

(21) Appl. No.: 09/920,643

(22) Filed: Aug. 3, 2001

(51) Int. Cl.[7] ..... A63C 9/00
(52) U.S. Cl. ..... 280/617; 280/14.21
(58) Field of Search ..... 280/617, 618, 280/624, 619, 616, 623, 611, 626, 627, 631, 632, 633, 14.21, 14.22, 14.23, 14.24, 607

(56) References Cited

U.S. PATENT DOCUMENTS 5,556,123 A * 9/1996 Fournier ..... 280/607
5,727,797 A * 3/1998 Bowles ..... 280/14.2
5,899,483 A * 5/1999 Paris ..... 280/611
6,027,136 A * 2/2000 Phillips ..... 280/618
6,076,848 A * 6/2000 Rigal et al. ..... 280/634
6,116,634 A * 9/2000 Mometti ..... 280/613
6,199,893 B1 * 3/2001 Fumagalli ..... 280/602
6,206,403 B1 * 3/2001 Black et al. ..... 280/618
6,231,057 B1 * 5/2001 Reuss et al. ..... 280/14.21
6,283,482 B1 * 9/2001 Coulter ..... 280/14.22

* cited by examiner

*Primary Examiner*—Brian L. Johnson
*Assistant Examiner*—Bryan Fischmann
(74) *Attorney, Agent, or Firm*—Leong C. Lei

(57) ABSTRACT

More particularly to an improved binding structure of a ski having a fixing board at the rear part of the binding structure. The fixing board is coupled to a ringed plate on the binding structure, and two binding straps for fastening the ski boot plate disposed at an appropriate position in the middle and in the front section of the ringed plate, and a fixing base is disposed at the bottom of the ringed plate. The binding structure is fixed to the ski by the fixing base, and a positioning latch pillar is disposed at an appropriate position on the external edge of the fixing board. A release spring is fixed on the positioning latch pillar, and the other end of the release spring is fixed to an appropriate position on the ringed plate of the release latch pillar so that the fixing board can automatically resume its position to cover the binding structure. The above arrangement can automatically cover the binding structure on the fixing board of the ski and enhance the safety of the user.

2 Claims, 4 Drawing Sheets

FIXING STRUCTURE FOR SKIS

BACKGROUND OF THE INVENTION (a) Field of the Invention

The present invention relates to an improved binding structure for a ski.

(b) Description of the Prior Art

As civilization is progressing, people nowadays have different choices in the basic necessities of life including food, clothing, housing, transportation, and particularly in the areas of education and recreation, which have changed rapidly. The winter Olympic Games, which include sliding, help to popularize many winter sports. Therefore, to play these different sports, people have developed all kinds of sports equipment for athletic contestants and players. These include skis and sledges. Skiing equipment has a binding structure which binds snow boots to the skis in order to fix the human foot to the ski equipment. When a skier decides to put on skis, the skier stands an one foot and puts another foot onto the ski equipment. However, during this process, the player may lose his/her balance, and since the skier's foot is fixed to the binding structure of the fixing board of the ski, which is made of hard material, therefore the skier may be injured if he or she sits or falls on the fixing board.

Therefore, it is an object of the present invention to provide an improved binding structure for a ski which can obviate and mitigate the above-mentioned drawbacks.

SUMMARY OF THE INVENTION

The present invention relates to an improved binding structure for a ski.

It is the primary object of the present invention to provide an improved binding structure of a ski which includes a fixing board, a ringed plate, a binding strap, and a fixing base, characterized in that: the binding structure is disposed at an appropriate position on the ski such that the binding structure tightly binds and fixes a foot to the ski. The binding structure further comprises the fixing board, the plate strap, and the fixing base. The fixing board is disposed at the rear part of the binding structure, and a polygonal latch hole is disposed at an appropriate position on the fixing board such that the latch hole can be embedded by a polygonal positioning latch pillar and prevents the positioning latch pillar from rotating. The positioning latch pillar passes through the corresponding latch hole on the ringed plate and latches the fixing board onto the ringed plate. A release bracket is fixed to the front end of a positioning latch pillar and a release spring is fixed onto the release bracket, and a release latch pillar is disposed at an appropriate position of a ringed plate. Thereby another end of the release spring is fixed onto the release latch pillar and the fixing board can automatically resume its position to cover the binding structure due to the release spring. Two binding straps are disposed between the lateral side of the ringed plate and at an appropriate position at the front section for fastening the ski boots. The fixing base is disposed at the bottom of the ringed plate such that the binding structure can fix onto an appropriate position on the fixing board of the ski, so when the ski boots are fastened the release spring on the binding structure flat covers the fixing board of the binding structure is pulled upward and the ski boot is placed in the accommodating space of the binding structure, and the binding strap is used to fasten the ski boot tightly. When the ski boots are not in use, the fixing board will automatically spring downward into a horizontal position due to the release spring on both lateral sides of the fixing board, such that the fixing board covers the binding structure and prevents the user from sustaining any injury. This arrangement has the additional advantage of automatically covering the fixing board of the binding structure of the ski, thus preventing any injuries caused by sitting on the hard fixing board of the binding structure.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheet of drawings in which a preferred structural embodiment incorporating the principles of the present invention is shown by way of illustrative example.

DESCRIPTION OF THE PREFERRED EMBODIMENT

Figure 1:
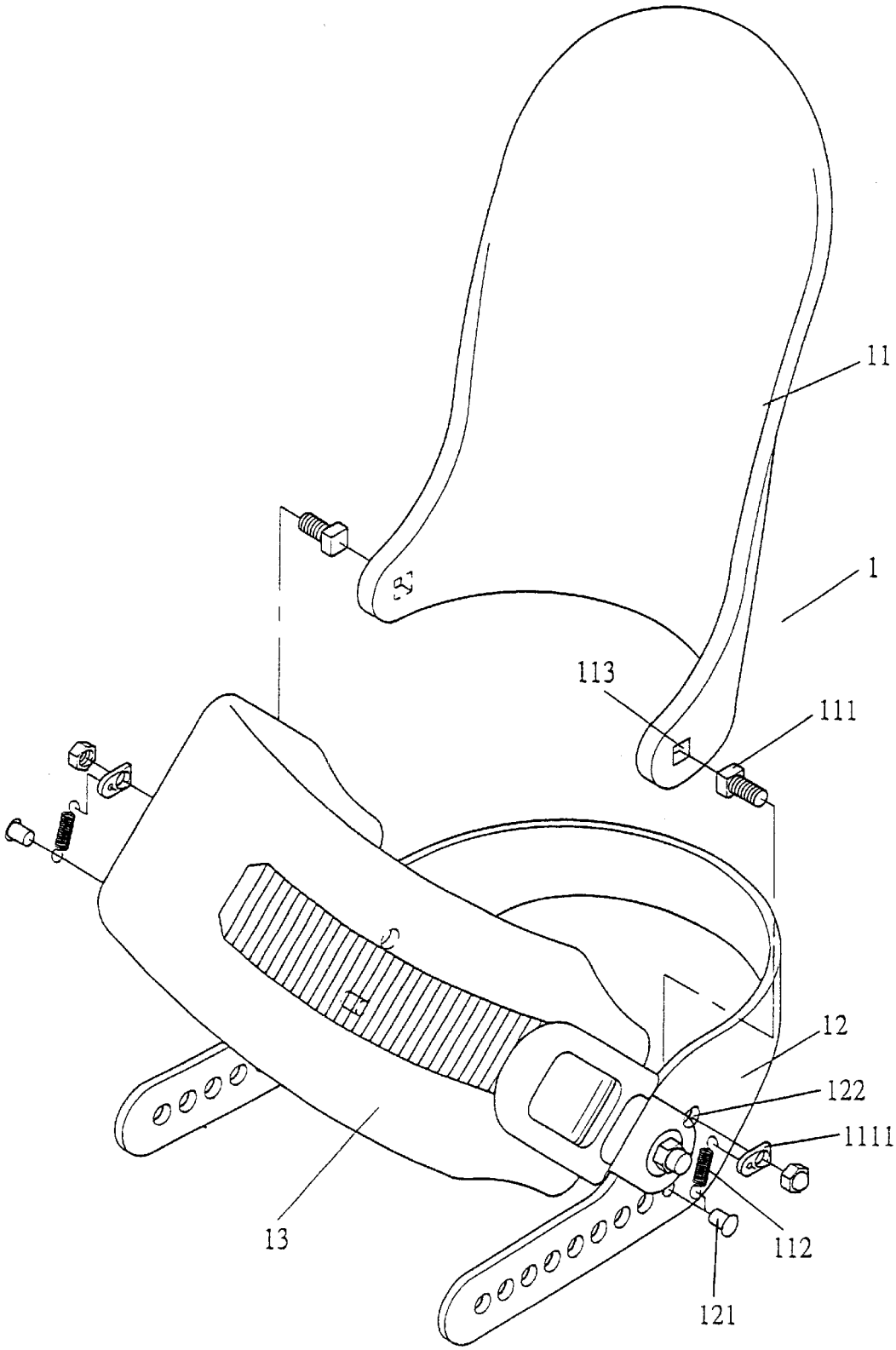
FIG. 1 shows the three-dimensional disassembled part of the structure according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby invaded, alterations and further modifications in the illustrated device, and applications of the principles of the invention as illustrated herein is contemplated as would normally occur to one skilled in the art to which the invention relates.

Figure 2:
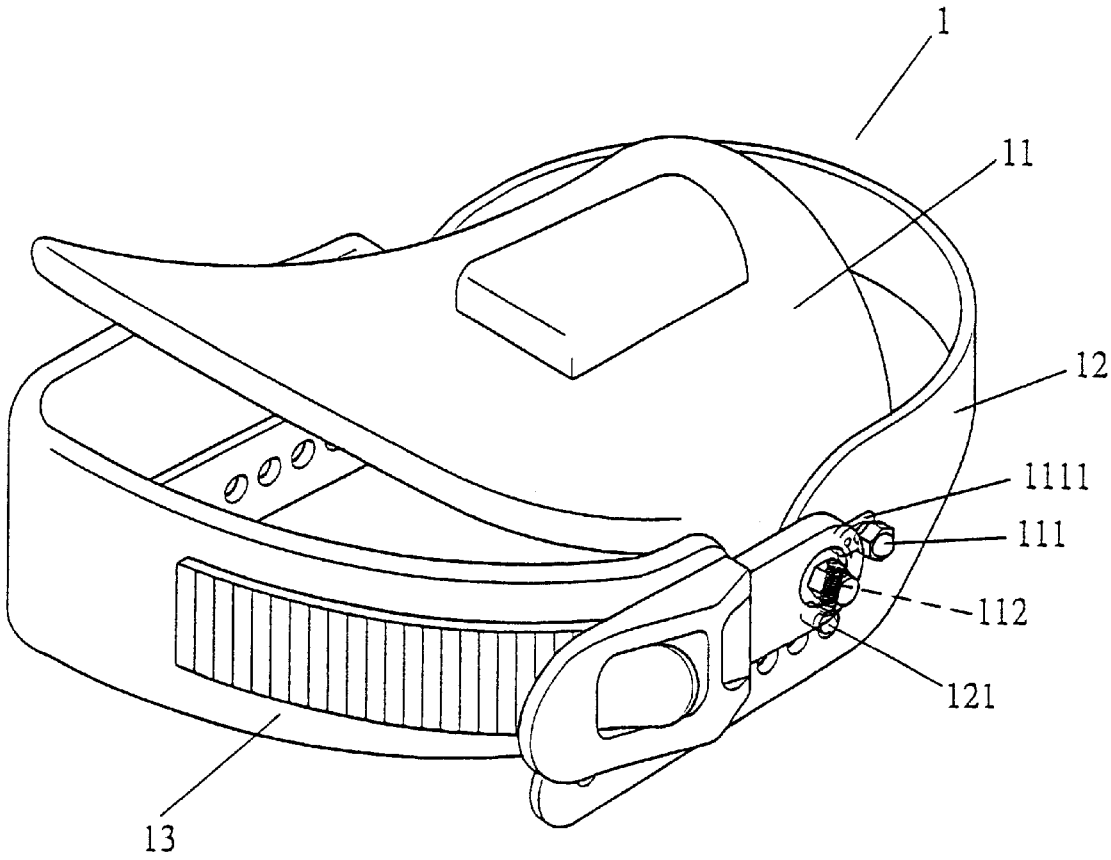
FIG. 2 shows the three-dimensional assembled structure according to the present invention.
Figure 3A:
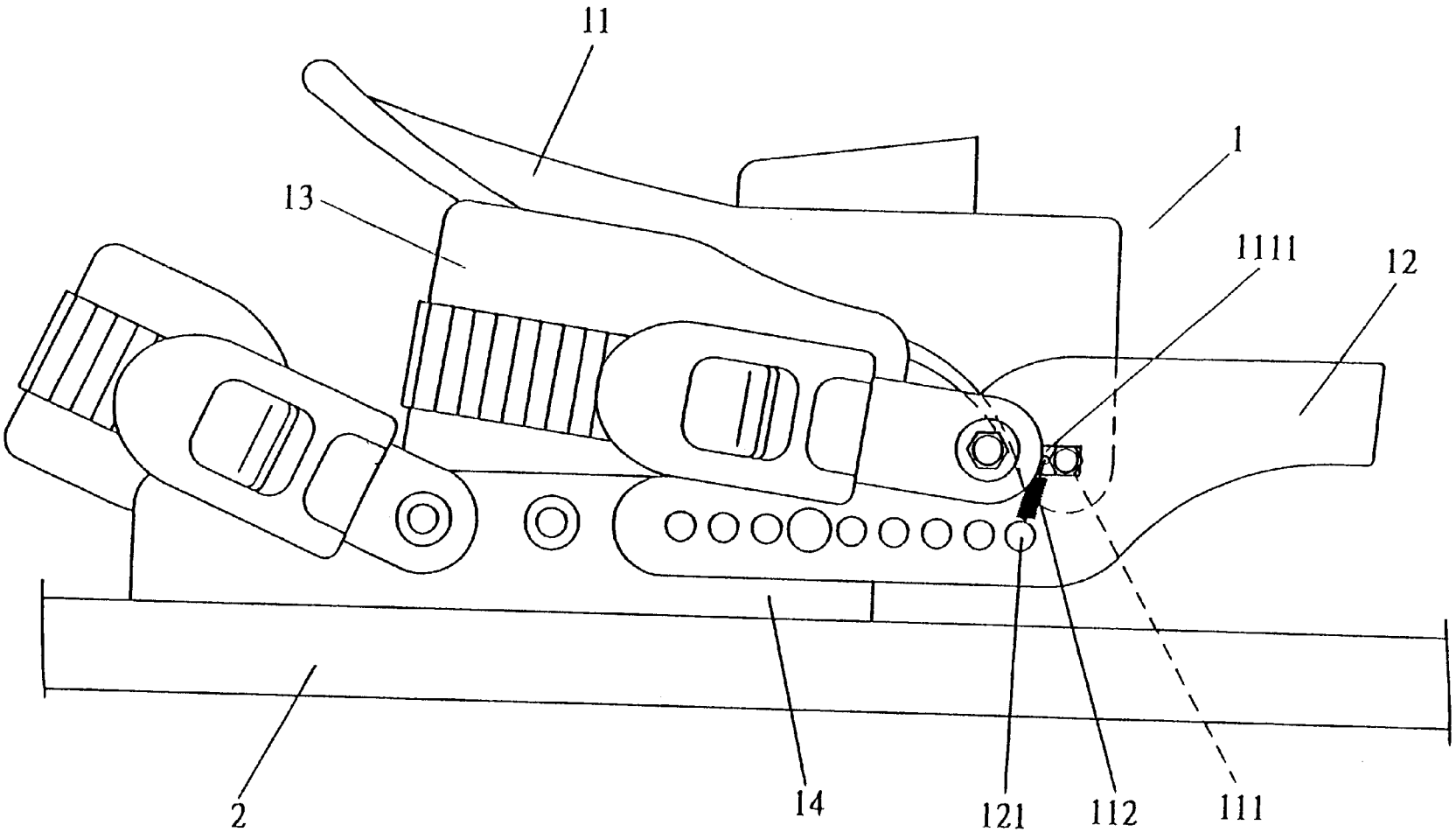
FIG. 3A is a cross-sectional diagram showing the action of a preferred embodiment of the present invention when it is in use.
Figure 3B:
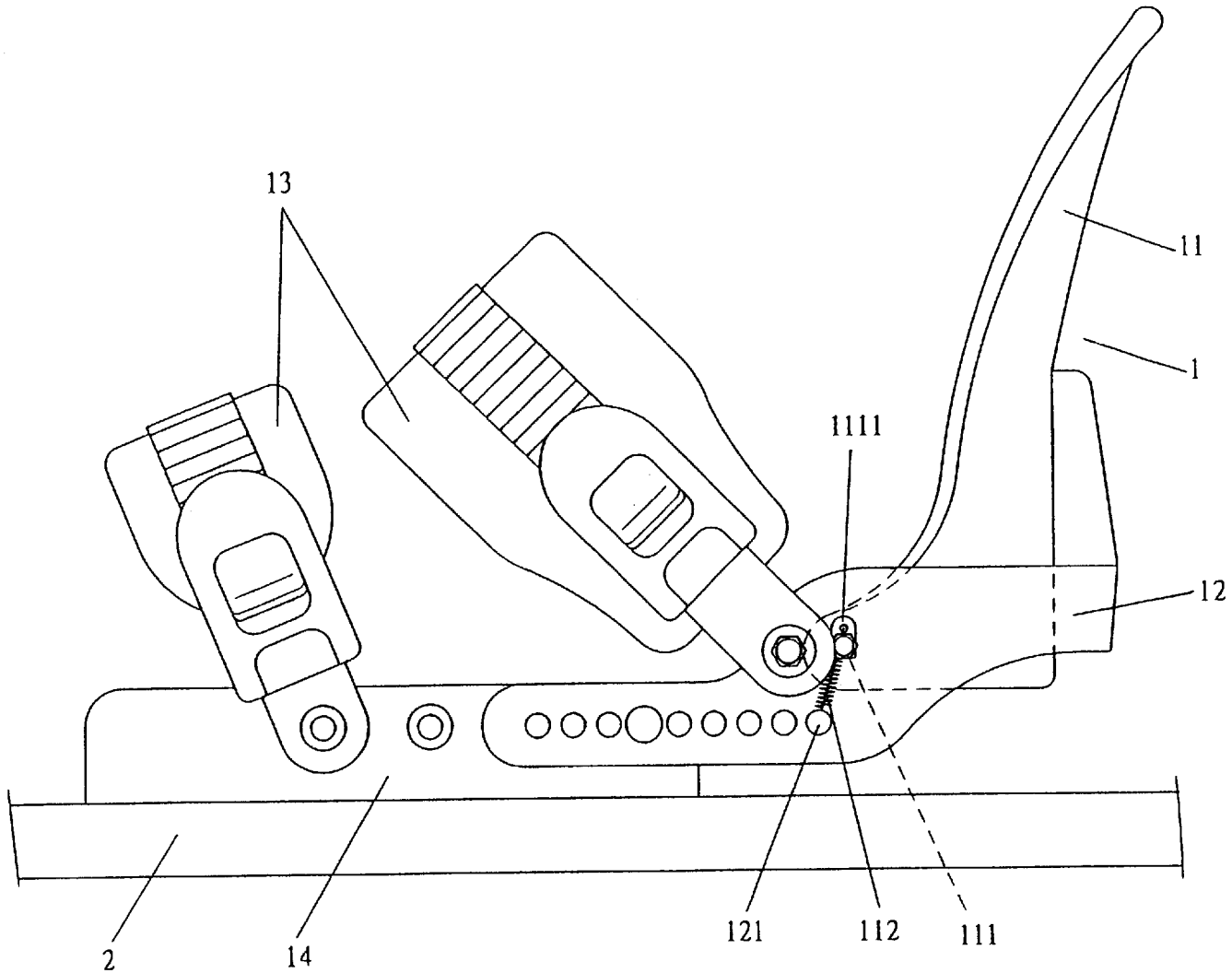
FIG. 3B is another cross-sectional diagram showing the action of a preferred embodiment of the present invention when it is in use.

Referring to FIGS. 1 to 3, these show an improved structure for a ski according to the present invention, which comprises a fixing board 11, a ringed plate 12, a binding strap 13, and a fixing base 14, wherein: a binding structure 1 is disposed at an appropriate position on the ski 2, and the binding structure is used for tying and fixing the user's foot in position. A fixing plate 11 is disposed at the rear section of the binding structure 1 such that both lateral sides of the bottom of the fixing board 11 are coupled to the ringed plate 11 of the binding structure 1, a polygonal latch hole 113 is disposed at an appropriate position on the fixing board 11, and a polygonal latch pillar 111 is latched into the latch hole 113 so that the positioning latch pillar 111 will not rotate, and the positioning latch pillar 111 passes through the corresponding latch hole 122 on the ringed plate 12. The fixing board 11 is latched onto the ringed plates 12, and the front end of the positioning latch pillar 111 is fixed to a release racket 1111, and a release spring 112 is fixed onto the release bracket 1111, and a release latch pillar 121 is disposed at an appropriate position of the ringed plate 12 such that the other end of the release spring 112 is fixed onto the release latch pillar 121, and the fixing board 11 can automatically cover the binding structure 1 by the release 112. Two binding straps are disposed between the lateral sides of the ringed plate 12 and at the appropriate position at the front section for fastening the ski boots. A fixing base 14 is disposed at the bottom of the ringed plate 12 such that the binding structure can be fixed at an appropriate position on the ski 2 by the fixing base 14. When fastening the ski boots, the release spring 112 on the binding structure 1 that covers the fixing board 11 of the binding structure 1 is pulled upward, and the ski boot is placed in the accommodating space of the binding structure 1, and the binding strap 13 is use, for fastening the ski boot tightly. When the ski boots are not in use, the fixing board 11 will automatically spring back to a horizontal position due to the release spring 112 on both lateral sides of the fixing board 11, and therefore the fixing board 11 will cover the binding structure 1, thus preventing the user from being injured in the case of falling or sitting on the fixing board of the binding structure. Therefore the arrangement according to the above description has a further benefit, which is to automatically cover the fixing board of the binding structure of the ski board, and thus prevent accidents or injuries caused by the binding structure.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. An improved fixing structure for a ski comprising a fixing board, a ringed plate, a binding strap, and a fixing base, wherein the fixing structure is disposed on the ski, the fixing board is disposed at a rear part of the fixing structure, a polygonal latch hole is disposed on the fixing board such that the latch hole may have a polygonal positioning latch pillar installed in the polygonal hole, thereby preventing the positing latch pillar from rotating, the positioning latch pillar also passes through a corresponding latch hole on the ringed plate and latches the fixing board onto the ringed plate, a release latch pillar is disposed on the ringed plate, a release bracket is fixed to an end of the positioning latch pillar, one end of a release spring is fixed onto the release bracket, the other end of the release spring is fixed onto the release latch pillar which causes the fixing board to pivot downward to cover the fixing structure when the ski is not being used.

2. The improved fixing structure for a ski of claim 1 in combination with a second binding strap.

* * * * *